United States Patent [19]

Lapierre et al.

[11] 3,998,362

[45] Dec. 21, 1976

[54] PORTABLE HOPPER APPARATUS FOR SUPPLYING A DRY MORTAR MIX

[75] Inventors: Gilles Lapierre, Pierrefonds; Jacques Dubois, Laval-des-Rapides, both of Canada

[73] Assignee: Miron Company Ltd., Montreal, Canada

[22] Filed: May 30, 1973

[21] Appl. No.: 365,425

[52] U.S. Cl. ..... 222/185; 222/465

[51] Int. Cl.[2] ..... B65G 3/06

[58] Field of Search ..... 222/181, 185, 462, 464, 222/465, 164, 165, 166; 294/69, 73; 214/17 R, 17 A, 307

[56] References Cited

UNITED STATES PATENTS

| | | | |
|---|---|---|---|
| 2,168,495 | 8/1939 | Rasmussen | 294/73 X |
| 3,123,107 | 3/1964 | Kappler | 222/181 X |
| 3,138,297 | 6/1964 | McKinney | 222/185 |
| 3,198,395 | 8/1965 | McKinney | 222/181 X |
| 3,224,653 | 12/1965 | Cooke | 222/462 |
| 3,469,742 | 9/1969 | Miller et al. | 222/185 X |

*Primary Examiner*—Robert B. Reeves
*Assistant Examiner*—Francis J. Bartuska
*Attorney, Agent, or Firm*—Raymond A. Robic; Arthur Schwartz; Leo A. Rosetta

[57] ABSTRACT

There is disclosed an apparatus for supplying a dry mortar mix comprising containers with a gate valve at one end and a hook at the opposite end and a support for holding at least two such containers with the gate valve lowermost and the hook uppermost. The support is placed at a construction site and the containers are filled at a plant with dry sand and cement mortar mix and are delivered to the construction site by truck. Installation of the containers and the support is done by a crane. Empty container(s) are removed and replaced by full one(s). Other container(s) can be tapped in the meantime to ensure that the supply of mix is continuous.

4 Claims, 6 Drawing Figures

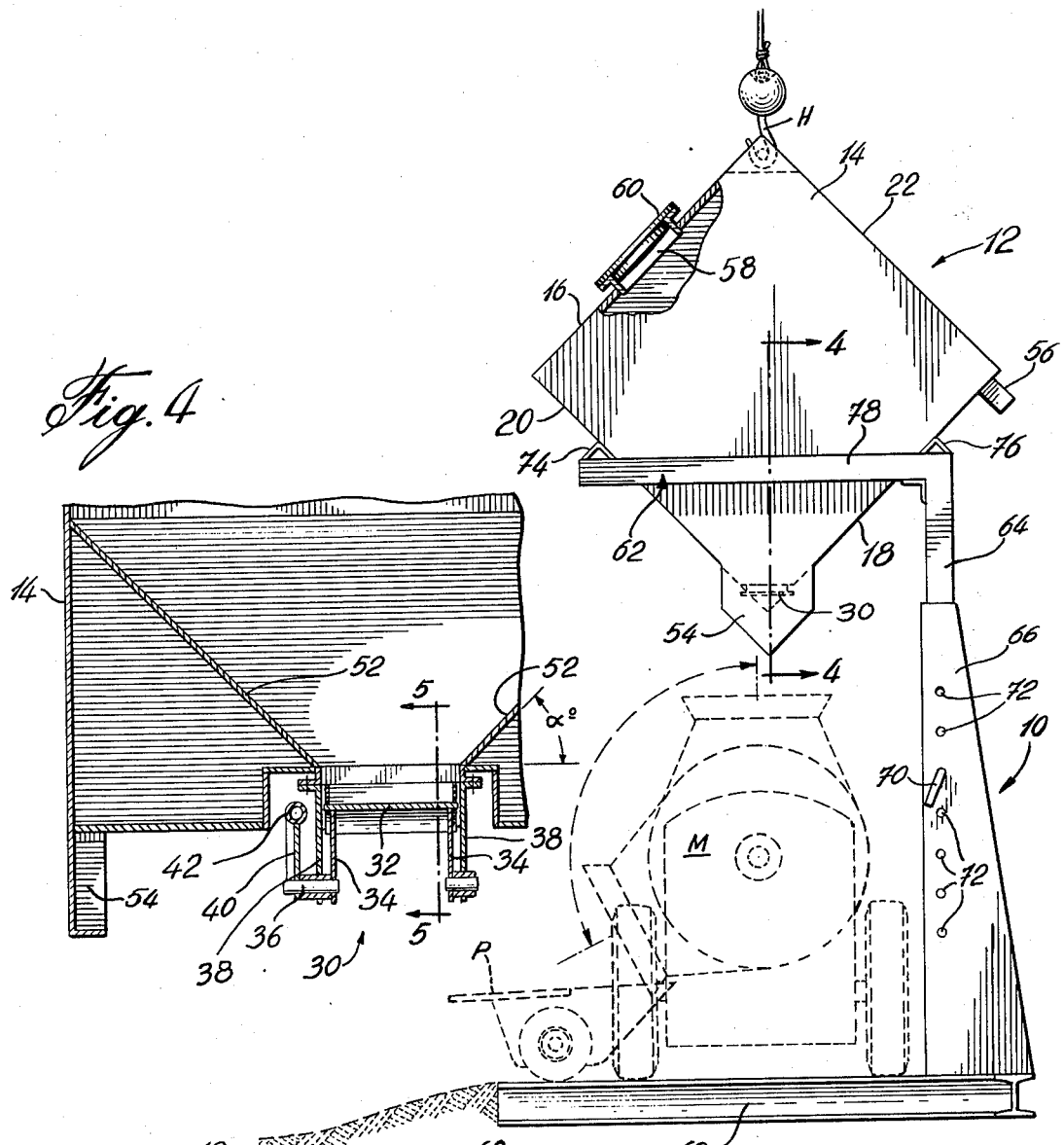
Fig. 4
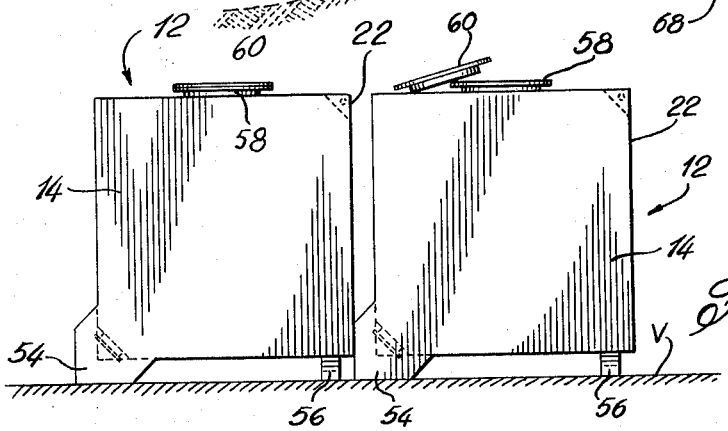
Fig. 2
Fig. 3

PORTABLE HOPPER APPARATUS FOR SUPPLYING A DRY MORTAR MIX

The present invention relates to an apparatus for supplying a dry mortar mix.

Current practice at construction sites for the supply of mortar is to have sand delivered by truck and placed somewhere in a pile, to have the cement and hydrated lime delivered in bags and placed somewhere else in a stack. The sand is shoveled into a mixer and the cement and lime are poured in from the bags.

This arrangement has a number of drawbacks. The sand tends to get dirty and thus lower the working quality and the strength of the mortar. The cement must be kept dry in order for it to be useable at all and provision must therefore be made to protect it from the elements. Furthermore, the proportioning of the ingredients is not precise there being no scales at the site thereby increasing the possibility of mistakes which may make the mortar unuseable or unsatisfactory with consequent waste of material.

This supply arrangement also takes up a large amount of space at the site which is a serious disadvantage especially when the construction site is located in a populated area. It is also known that if the sand is very clean, if the proportions are precisely controlled and if mixing is very thorough, the plasticizer may also be in dry form admixed with the cement. Dry mixes in which these conditions are present are currently supplied in bags. The use of bags is, however, uneconomical, the handling thereof is difficult and dry storage conditions must again be insured.

It is an object of the present invention to provide an apparatus for supplying a dry mortar mix at a construction site which overcomes the aforementioned disadvantages.

The apparatus according to the invention comprises a container having a gate valve and a handle at opposite ends thereof, a stand with supporting means for supporting the container in an elevated position wherein a line joining the handle with the center of the gate valve is substantially vertical; the lower portion of the container is formed of four opposite internal walls, the planes thereof intersecting at the gate valve. In the latter unloading position, i.e., where the vertical axis of the container in rest position is tilted to 45°, two of the above walls will comprise the bottom and opposite side wall of the container, each thus forming an angle of 45° with respect to the horizontal, while the two remaining internal opposite walls will consist of two additional walls mounted in said container at an angle of 50° with respect to the horizontal. The positioning of the container together with the plane angles of the internal walls enable the sand and cement mix to flow with negligible segregation. The containers are filled at a plant with premixed sand and cement and the last mentioned feature of the invention ensures that all samples drawn from the container whether the same is full or nearly empty, will contain essentially the same proportion of sand and cement so that the quality and handling properties of the mortar will be constant.

Further according to the invention, the container has a side constituting a configuration supporting the container in rest position, the container in rest position having the handle disposed near the topmost portion thereof. This rest position is used for filling, transporting and storing the container. These containers are of relatively large size and must be handled with a crane. This feature of the invention ensures that the handling of the containers will be convenient. Further according to the invention, the container in the rest position has the gate valve disposed near the lowermost portion thereof, the container comprising projecting portions surrounding the gate valve to protect the same. This arrangement prevents damage of the gate valve so that the same can always easily be opened and closed at the construction site.

Still according to the invention, the container has a filling hatch disposed in the rest position in the topmost side thereof for convenient filling and a cover for the hatch to keep the contents dry and clean and prevent spilling thereof during transport.

Further according to the invention, the container is in the shape of a rectangular hexahedron with the gate valve and the handle disposed centrally along two opposite edges thereof. This shape is simple and economical to build and enables the containers to be stored and transported without waste of space.

Still according to the invention, the gate valve and the handle are recessed with respect to the edges and the four faces adjacent thereto.

The remaining two faces of the container comprise extensions at the corners thereof adjacent the edge having the gate valve so as to protect the gate valve as aforementioned and one of the faces adjacent this edge carries legs near the opposite edge of height equal to the perpendicular projecting distance of these extensions. The container will thus be evenly supported during filling and transport without damage to the bottom face thereof. The filling hatch is on the face of the container opposite the legs that is on the upmost face in filling position.

Further according to the invention, the stand comprises a rectangular opening having one dimension slightly greater than the length of the edges carrying the gate valve and the handle so that the container can be slipped into the opening and the other dimension substantially smaller than the distance between the two edges of the container parallel to the aforementioned edges carrying the gate valve and the handle. As a result during installation of the container by means of a crane, the container will automatically take up a position in which the gate valve is vertically directly under the handle and the adjacent external faces of the container are each at 45° to the vertical. The stand is installed at the construction site so that the rectangular opening is substantially horizontal and the aforementioned internal walls are at a suitable angle to provide for proper flow of the mix.

Further according to the invention, a plurality of such containers are provided and the stand has means for supporting at least two such containers simultaneously so that when one or more are empty ones, mix can be drawn from the other (s) while empty are being replaced. As a result, the supply mix at the site is continuous.

A preferred embodiment of the invention is illustrated by way of example in the accompanying drawings in which:

FIG. 2 is a side elevation of the apparatus;

FIG. 3 is a side elevation of two containers in transport position;

FIG. 4 is a section of a container along line 4—4 of FIG. 2;

Figure 1:
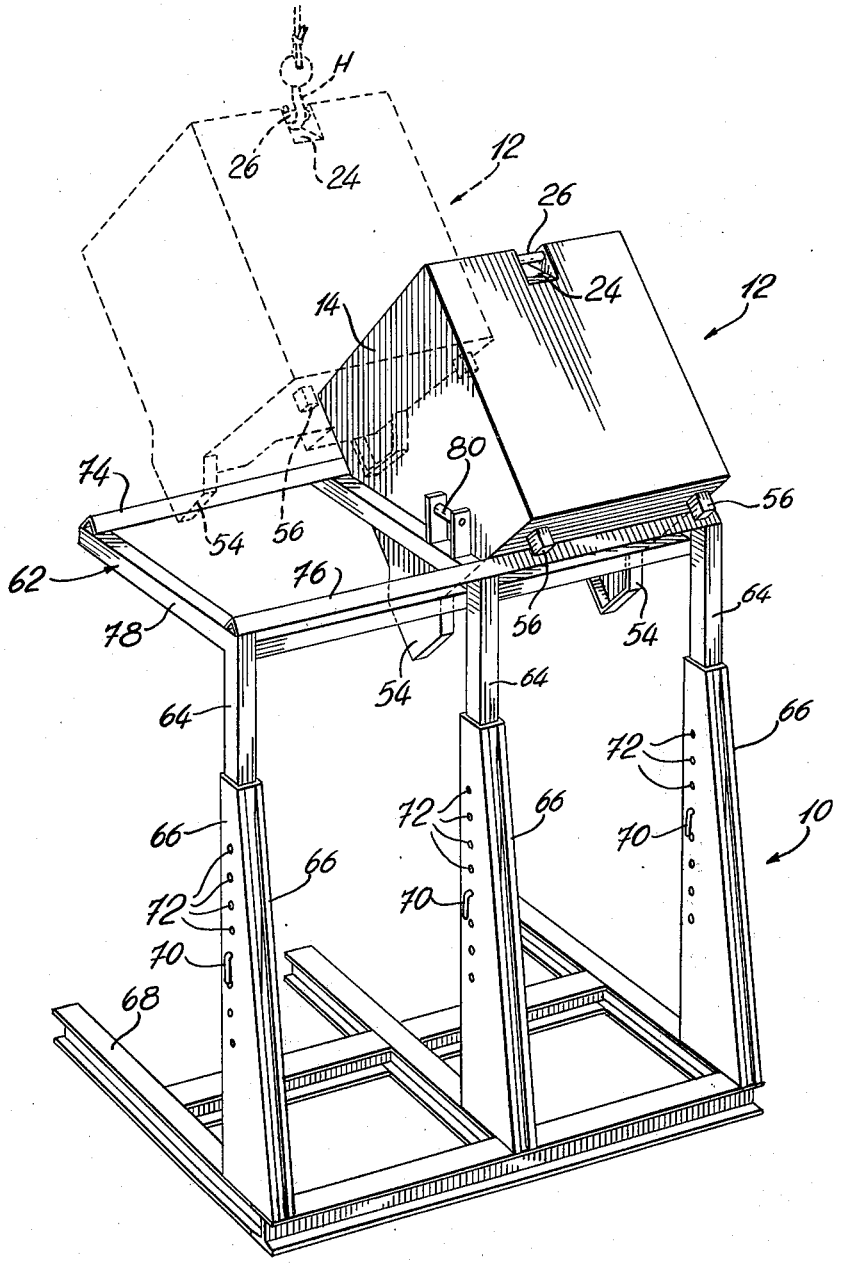
FIG. 1 is a perspective view of a supply apparatus according to the invention.

Referring to the drawings, the supply apparatus according to the invention comprises two distinct elements, namely a stand 10 and containers 12.

Each container 12 is in the shape of a rectangular hexahedron with opposite side faces 14 substantially square, a top face 16, a bottom face 18, a front face 20 and a rear face 22 (FIG. 2).

Faces 16 to 22 are in the shape of rectangles with their dimensions perpendicular to faces 14 selected to fit conveniently the span of a transport vehicle (FIG. 3) so that two such containers may be placed side by side on the vehicle bed in the transverse direction. The dimension of square side faces 14 including the extensions thereof as will be described hereunder, is selected so that a multiple of this dimension fits conveniently the longitudinal extent of the vehicle bed so that several containers can be aligned on the vehicle.

Centrally of the edge joining up face 16 and rear face 22 is a recess 24 spanned by a rod 26 parallel to the edge and constituting a handle which may be engaged by the hook H of a crane (not shown) preferably mounted on the vehicle.

Figure 5:
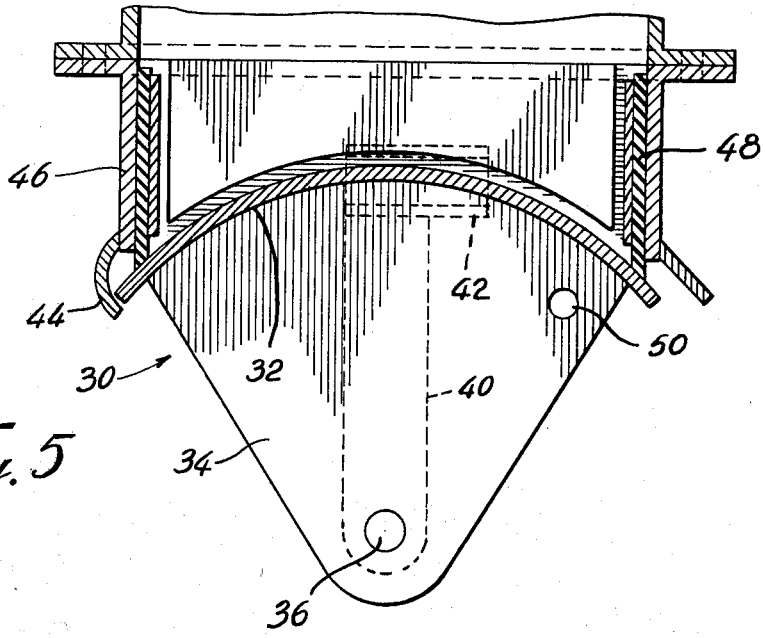
FIGS. 5 and 6 are detail sections of a gate valve for the container taken along line 5—5 of FIG. 4, in closed and open position respectively.
Figure 6:
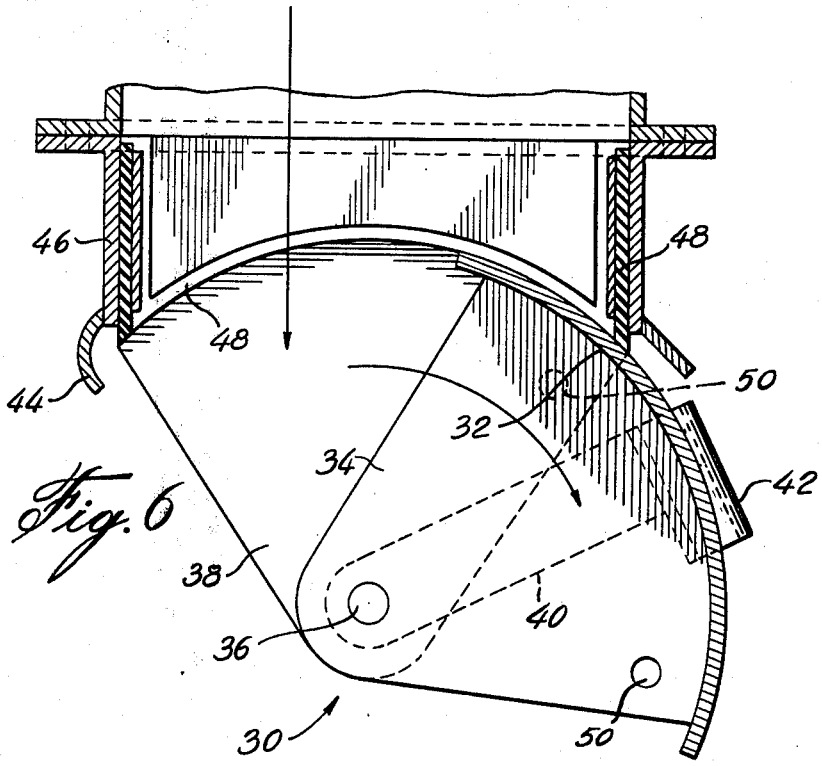

The edge common to the bottom face 18 and the front face 20 opposite the handle 26 is provided with a valve 30 (FIGS. 4–6) comprising a circular gate 32 mounted on wings 34 which are secured to shafts 36 pivoted on brackets 38 connected to the container. As can be seen in FIG. 2, the gate 32 of gate valve 30 is recessed with respect to the container faces 18 and 20.

Shafts 36 are at the center of curvature of gate 32 and the gate is rotated thereabouts by means of a lever 40 rigid with one of shafts 36. The extremity of lever 40 carries a bushing 42 through which may be placed any rigid elongated member such as a steel bar to increase the leverage for opening and closing the gate valve 30. The gate 32 abuts at one end of its run against a stopper 44 secured to the mouth 46 of the gate valve which is provided all around with sealing members 48. Holes 50 in wings 34 and brackets 38 match in the closed position of the gate 32 for insertion of a locking device such as a bolt or a padlock (not shown).

The mouth 46 of the gate valve connects in the interior of the container with a pair of opposite walls 52 forming a funnel and having their outer edges connected to side faces 14 and to front and bottom faces 20 and 18 (FIG. 4).

The funnel walls 52 are disposed at an angle to the horizontal indicated at $\alpha$ in FIG. 4. This angle has been empirically determined by analyzing a large number of samples drawn from the container at various stage tests in the emptying thereof as having the value of 45° for the two opposite side walls and of 50° for the two remaining opposite walls which have been additionally mounted in the container. It has been found that deflections greater than $\pm 1°$ from these angles in either direction will affect the flowability of the mix.

The side faces 14 of the container 12 have extensions 54 at the corners located at the edge joining front and bottom faces 20 and 18 which extensions 54 project beyond any of the structure connected with gate valve 30 so as to protect the gate valve from damage. The extensions 54 are diagonal with respect to faces 14 and are limited outwardly by edges parallel respectively to faces 18 and 20. Face 18 has at the opposite corners a pair of legs 56 which are of height equal to the perpendicular projecting distance of the extensions 54 with respect to the face 18. As shown in FIG. 3, the containers may be rested on the extensions 54 and legs 56. In this rest position, the face 18 is the bottom face and the opposite face 16 is the top face. Face 16 is provided with a filling hatch 58 for pouring the mix into the container 12. The hatch 58 is provided with a cover 60 fastened thereon by any suitable means (not shown) such as frictional engagement, a screw thread or a lever lock.

The support 10 as shown in FIGS. 1 and 2 comprises a shelf 62 with legs 64 which are telescopically supported by posts 66 secured to a base 68. The legs 64 slide in the posts 66 to adjust the height of shelf 62 and are held in position at the adjusted height by pins 70 inserted through matching holes 72 of the legs 64 and posts 66. The base 68 is made of beams resting on the ground in a suitable location at the construction site. The beams 68 may be covered with earth or gravel as shown in FIG. 2 to provide a smooth runway for vehicles.

The shelf 62 consists of front and rear steel angles 74, 76 placed with their convex corners uppermost and three cross members 78 forming two rectangular openings side by side. The distances between cross members 78 are slightly larger than the dimensions of faces 16 to 22 perpendicular to faces 14 so that a container can be slipped between cross members 62 with the side faces 14 along the cross members 78. The front and rear members 74 and 76 provide rest surfaces at 45° for front and bottom faces 20 and 18 of containers 12. The distance between members 74 and 76 must of course be substantially smaller than the diagonal of faces 14. A handle 80 is connected to shelf 62.

In the use of the apparatus, the support 10 is installed at the construction site and a truck V with a crane (not shown) mounted thereon brings a pair of containers 12 and installs them in the support with the diagonals of faces 14 respectively in horizontal and vertical directions, the gate valve 30 in this position being lowermost. This position is obtained automatically when installing the containers in the support 10 because the hook H of the crane holds the container in this position as the container is being lowered into the support 10.

A mixer M is placed with its mouth directly underneath the gate valve 30 of one of the containers. The gate valve is opened as needed to supply mix into the mixer and a mortar pan P is placed under the outlet spout of the mixer M. The pan P may be handled by lift truck (not shown) or it may be wheel mounted.

Whenever the first selected container 12 is empty, the mixer M is wheeled under the second container and the empty container is removed and placed on truck V and replaced by a full container simultaneously.

The truck makes the rounds of any number of construction sites picking up empty containers and replacing them by full ones and then takes the empty containers back to a mixing plant or storage station to refill the containers for the next round. The containers are set up on the truck in filling position and need not be removed therefrom in order to be filled.

It will be seen that the arrangement according to the invention provides a speedy, economical, convenient and orderly way of supplying mortar mix to construction sites.

We claim:

1. Apparatus for supplying a dry sand and cement mortar mix or the like at a construction site, comprising:

a supporting stand having elevated shelf means defining at least one generally square opening therethrough;

a generally cubical container removably seated in said opening with two adjacent walls extending obliquely downwardly through and resting on opposite sides of said opening and having a selectively openable valve at the juncture of said adjacent walls, below said opening;

an upper edge of said container parallel to said juncture being substantially directly above said valve and being provided with a lifting handle at said edge;

oblique internal walls in said container, extending between said two adjacent walls and defining therewith funnel-like guiding surfaces for directing dry mix within said container toward said valve;

wherein opposed side walls of said container perpendicular to and extending between said adjacent walls being configured to define extensions extending diagonally from said juncture, all portions of said valve being within the lateral outline of said extensions; and legs extending from said container at the edge of one of said adjacent walls opposite said juncture whereby said legs and extensions may support said container on a horizontal surface with said one of said adjacent walls extending generally horizontally above said surface and with all portions of said valve being above said surface.

2. Apparatus as defined in claim 1 wherein said lifting handle is recessed within the outer surfaces of said container.

3. Apparatus as defined in claim 1 wherein the side of said container opposite said one adjacent wall is provided with a filling hatch having a removable water-deflecting cover.

4. Apparatus as defined in claim 1 wherein said adjacent walls extend at an angle of about 45° to the horizontal and wherein said oblique internal walls extend at an angle of about 50° to the horizontal whereby dry mix in said container will flow to said valve with negligible separation of its components.

* * * * *